US008869583B2

(12) United States Patent
Meiners et al.

(10) Patent No.: US 8,869,583 B2
(45) Date of Patent: Oct. 28, 2014

(54) MULTI-SIDED TUBE SWAGING APPARATUS AND METHOD

(71) Applicants: Carl Meiners, Ballwin, MO (US); Mark Meiners, Chesterfield, MO (US); Rob Meiners, Chesterfield, MO (US)

(72) Inventors: Carl Meiners, Ballwin, MO (US); Mark Meiners, Chesterfield, MO (US); Rob Meiners, Chesterfield, MO (US)

(73) Assignee: Tublar USA, Inc., Weldon Springs, MO (US)

( * ) Notice: Subject to any disclaimer, the term of this patent is extended or adjusted under 35 U.S.C. 154(b) by 99 days.

(21) Appl. No.: 13/694,338

(22) Filed: Nov. 21, 2012

(65) Prior Publication Data

US 2013/0125608 A1 May 23, 2013

Related U.S. Application Data

(60) Provisional application No. 61/629,607, filed on Nov. 23, 2011.

(51) Int. Cl.

| | |
|---|---|
| ***B21D 41/02*** | (2006.01) |
| ***B21D 41/04*** | (2006.01) |
| ***B21D 9/00*** | (2006.01) |
| ***B21D 22/02*** | (2006.01) |

(52) U.S. Cl.

CPC *B21D 9/00* (2013.01); *B21D 41/04* (2013.01); *B21D 22/025* (2013.01)

USPC ..... 72/370.13; 72/370.25; 72/370.26; 72/370.02; 72/402

(58) Field of Classification Search

USPC ..... 72/370.02, 370.04, 370.05, 370.13, 72/370.25, 370.26, 393, 400, 402

See application file for complete search history.

(56) References Cited

U.S. PATENT DOCUMENTS

| | | | | | |
|---|---|---|---|---|---|
| 3,406,548 | A | * | 10/1968 | Wilcox | 72/71 |
| 3,726,121 | A | * | 4/1973 | Arnold et al. | 72/402 |
| 3,857,666 | A | * | 12/1974 | Barnett | 425/393 |
| 4,701,869 | A | | 10/1987 | Callegari, Sr. et al. | |
| 4,722,216 | A | * | 2/1988 | Fencl | 72/402 |
| 5,836,197 | A | * | 11/1998 | McKee et al. | 72/402 |

FOREIGN PATENT DOCUMENTS

| | | |
|---|---|---|
| WO | WO 98/41338 | 9/1998 |

* cited by examiner

*Primary Examiner* — David B Jones
(74) *Attorney, Agent, or Firm* — Paul M Denk

(57) ABSTRACT

An apparatus and method for swaging a square or rectangular tube, the apparatus including a support for external dies, both surface dies and corner dies, which when actuated, apply pressure to the outside of a tube to achieve its swaging to a lesser dimension, and having a collapsible mandrel located therein, supporting internal dies, that apply a lesser pressure against the interior of the tube, during a swaging operation, to assure that wall buckling does not occur. An internal die with its removing tool may locate within the end of the tube to be swaged to cooperate with the pressure from the external dies to swage the tube without any final buckling.

18 Claims, 15 Drawing Sheets

MULTI-SIDED TUBE SWAGING APPARATUS AND METHOD

CROSS REFERENCE TO RELATED APPLICATION

This non-provisional patent application claims priority to the provisional patent application having Ser. No. 61/629,607, filed on Nov. 23, 2011.

FIELD OF THE INVENTION

This invention relates to the concept of swaging a multi-sided metal tube, particularly to reduce its dimensions, through the usage of a combination of a compression machine, and a collapsible power mandrel, mated together, or a solid mandrel, in order to provide for a reduction in the dimensions of a portion of the tube and without deteriorating its preferred multi-sided configuration.

BACKGROUND OF THE INVENTION

This invention relates to the swaging of preferably a square tube.

In the past, others have tried to swage tubes, in order to reduce their dimensions, and normally this could be done through the use of an external compression means, that would apply pressure around the periphery of the tube, to decrees its dimensional capacity. Normally this was done with round tubes, which could be carefully pressured by some type of dies or roller means around its circumference, and which would affect the reduction in its diameter, to a slight amount, without causing a buckling of the round tube itself.

But, others have tried to swage a rectangular tube, utilizing the same principle of applying force upon the exterior surface of the tube, but generally have not succeed in their efforts, because square tubes, unlike round tubes, have a tendency to buckle along the straight sides of their configuration, when subjected to pressure along the sides, and around the corners, in an effort to reduce the tubes dimensions.

Normally, tubes are reduced in size for the purpose of allowing a series of such tubes to be connected together. If the ends of a tube can be reduced in size, it can then fit inside the next aligned tube, to make it easier to connect a series of such tubes together, where such may be required for installation purposes.

An example of a tool for working shaped, hollow metal tubing to achieve its end reduction can be seen in the published international application to Soder, International Publication No. WO 98/41338. As can be seen, it utilizes a series of rollers, which applies compressive forces along the upper and lower surfaces, and the side surfaces, of the tube being worked, as to be noted. But, generally, when such type of external compression is applied to a multi-sided tube, such as a square tube, and as to be noted in FIG. 1 of this application, the flat side portion of the tube has a tendency to buckle, as explained, which means the tube must be scraped, since it becomes inutility.

A much more substantial connecting means between tube lengths, and some of these tube lengths may be of a length of 20 to 40 feet in length, if the end of the tube is damaged because of buckling, it makes the tube unusable, and requires that end of the tube to be cut off, in an effort to try to swage a new end for the tube to make it useful: For example, some of these tubes may be approximately 24 feet long, and heretofore, when they may be assembled into, for example, a TV antenna, which may be a 100 feet tall tower, the only way to combine such tubing was to utilize a small length of tube, in which the two ends of two tubes may inset, and then be joined through bolting, or being welded in place. Another method was to use butt welding of the ends of the two adjacent tubes, or in the alternative, to use some other kind of especially designed fitting. But, these means for connection while they may hold up under short term usage, when subjected to lateral forces, such as wind, and the like, do have a tendency to break, or bend, because the means for connection is just not that stable. Hence, the desirable manner for interconnecting such tubes together is to be able to swage uniformly one end of the tube, and allow the opposite end of another tube to insert thereover, and then either weld or bolt the tubes sections together, to provide for a highly stable tubular joint connection.

In the past, commonly tubes were joined end to end by various common methods. These included the placement of one sleeve of a smaller size that fitted within the I.D. of the tubes being joined, and then were bolted or welded in place. Another method including the butt welding method and such welding is very difficult to accomplish, and to maintain structural strength, particular where thinner walled tubes were involved, and had to be joined. In addition, there are specially designed fittings that could be used for holding tubes ends together.

It has generally been recognized that it is difficult to swage a square or rectangular tube; it is rarely ever accomplished primarily because the tube surfaces have a tendency to buckle, or crimp, and therefore lose their square or rectangular integrity.

It has been know that swaging of a round tube can be accomplished. It has been done on either a segment swager or the tube is forced into a die that has the desired shaped of the tube after its fabrication. Due to the symmetric nature of the round tube, no I.D. mandrel, such as a support mechanism, normally is required. As force is apply, such as by squeezing on to the round tube, the walls want to buckle in the outward direction. But, the die doing the squeezing is there to keep that from occurring. Instead of buckling, the material compresses, thickening the wall and lengthening the tube. In cases of very thin wall thickness, and relatively large diameter of the tube, the material will find a way to buckle inwardly. This problem is generally magnified if the material is of a very high strength and resists forming.

If one attempts to use the same process on a square or rectangular tube, as done with the round tube, the wall first wants to buckle as it does with the round tube, but it does not care if it is an inward buckle or an outward buckle. Since the dies are there to stop the outward buckle, it normally goes inwardly. The buckle is inconsistent in appearance and dimensions and results in a useless part.

Thus, the concept to swager a square tube is to support the I.D. or the inside diameter of the tube, so that the walls cannot buckle inwardly. The immediate problem one encounters by placing some sort of support in the I.D. of the tube is that after the swage is complete, the finished tube is crimped tightly on the support and must be extracted with significant force. There are prior art custom built machines that have used hydraulics, to ram the tube into a die to achieve a final shape, but such machines are inconsistent of results, and they are extremely expensive to manufacture.

SUMMARY OF THE INVENTION

The concept of this invention is to utilize a collapsible or tapered mandrel, that may locate within a segment, generally the end part, of a multi-sided tubing, usually square tubing, in order to apply pressure eternally of the tubing sufficiently to prevent buckling of the tube walls, during its reduction swaging, while simultaneously, applying external dies to compress the tube during swaging into a lesser dimension, at least sufficiently to allow the swaged end of the tube to insert within an adjacent tube, when they are desired to be coupled together when forming a lengthy structure.

Thus, the concept of the invention is to use custom compressive dies subject to significant hydraulic pressure, to cause their inward pressure upon the outer surfaces of the tube, in order to provide for reduction in its dimensions, but at the same time, incorporating a removable mandrel, which may either be physically or hydraulically actuated to apply sufficient pressure to the interior of the tube, along all of its surfaces, so as to prevent inward tube buckling while it is being swaged, but also, to allow the internal mandrel to be either physically or hydraulically reduced in size, to furnish its ease of removal once swaging has occurred. Heretofore, efforts to utilize a mandrel within a tube, while it is being swaged, cause the mandrel to be tightly fixed and bound in place, which made it exceedingly difficult to attain its removal, after any swaging has occurred. The concept of the current invention is to provide a collapsible type of mandrel, whether it be done either mechanically, or through hydraulic pressure, so that once swaging has occurred, and the pipe has been reduced in dimensions to the precise lengths desired, the mandrel can be easily removed through its collapsing, once the process has been completed.

Another concept of this invention is to utilize a mandrel that is of slightly lesser dimensions than the swaged I.D. of the final tube end. Then, pressure may be applied through the use of a slide hammer, or other removing instrument, to force the mandrel out of the swaged tube, when the process has been completed. The addition of a lubricant, on the surface of the mandrel, such as a silicone lubricant, may further assist in the rapid removal of the mandrel from the swaged tube end, when it has been structurally reduced in dimensions through the swaging operation.

Thus, it is the combination of a series of externally located flat side and corner dies within a holding mechanism that applies pressure, either mechanically, but preferably hydraulically, to force those dies uniformly inwardly under excessive pressure, in the rage of 4,000 to 10,000 psi, that provides for uniform contraction of the tubes outer dimension, and to that degree and lengths desired for the final product. This has been achieved through the use of software, which operates the hydraulically controlled dies, that provides for their inward movement, to compress against the surface of the square tube, along all surfaces, and the corners, in order to achieve precise compression to that dimension desired for the swaged tube, at its end, and within tight tolerances.

It was then realized that there would be a need for some sort of a die that provides for support, and yet shrinks or reduces in size as the swaging process continues, and as a result, there was developed a rather complex system utilizing hydraulic cylinders, and pressure relief valves, to attain control of the collapsible style mandrel, to assure that buckling does not occur, particularly of the side walls of the tube being worked, but at the same time, adds sufficient pressure internally to assure that precise dimensions for the swaged tube are achieved, in the final process. As previously commented, one of the problems encountered in providing some type of internal dimensional support for the tube is that after the swage is complete; the finished tube is crimped tightly on the support and must be extracted with great force. But, if a mechanical means, or hydraulic means, is added to a collapsible mandrel, not only can the regulation of the pressure of the mandrel be maintained during the swaging operation, but the dimensions of the mandrel can be substantially reduced, after a swaging operation, to achieve its ease of removal.

In designing the dies of the compressible mandrel, it was determined that such dies are required that provide the support for the interior of the tube, but it shrinks as the swage process continues. The concept of the invention developed is a rather complex system utilizing hydraulic cylinders and pressure relief valves. The hydraulics holds the internal dies in place against the inside wall of the tube. As the outer dies compress, the pressure release valve on the cylinder is set to allow the internal dies to compress, but still maintain a holding power to resist any buckling of the walls of the tube being swaged. During the swaging process, while the walls slightly buckle, they then straighten themselves out once they are forced by the holding mandrel to conform to the external dies. Then, by utilizing the collapsible mandrel, which at the end of the swaging process can be further reduced in size, it becomes easy to remove the mandrel from inside of the end of the swaged tube, to complete the tube end reduction process. To further allow for the mandrel to be removed, the center of the mandrel includes a threaded aperture, and a rod is inserted and threadily engaged within the threaded aperture, to provide for an easy pull out of the rod and the mandrel from interior of the reduced shaped tube. This reduction of the collapsible mandrel can be attained hydraulically, to reduce it further and to attain its removal, or the mandrel may be formed of its internal dies, with internal tapered surfaces, so that the wedging auger holding the internal dies in position can be physically removed through the use of a sliding weight, that biases against the rod, causing it to remove from its tapered mating within the said internal dies, allowing for a complete removal of the collapsible mandrel from its location, following a swaging operation.

The outside dies that extend substantial force against the surfaces of the tube to be swaged, are a multiple series of dies that include flat dies that bias against each flat surface or side wall of the tube, and in addition, are aligned with corner dies, that have a sharp enough radius on the corners, so that the sharper radius provides more locations for the metal material to flow, and makes the swaging process easier, while providing a uniform reduction in the tube dimensions, when completed.

As an example, for a tube having an outside dimension of approximately 4 inches on a side, and having corners of approximately a quarter inch in radius, it has been found that the flat surface dies that bias against the flat walls of the tube will have a surface of approximately 2.23 inches in length. The corner dies will have a radius of approximately 0.2030 inches in radius. The length of each die will depend upon the length of the swage desired, but normally a 4 to 5 inch length of a reduced segment of the tube will provide sufficient depth for locating the crimped segment internally of the next adjacent tube, when they are coupled together to make a tube of substantial length, as previously summarized.

Also, software is provided for furnishing operations of the amount of hydraulic pressure exerted by the various dies, both for the external compression dies, as they exert a force against the outside of the tube, to form its reduction in dimensions, and the somewhat lesser amount of force applied by the collapsible mandrel, upon the internal surfaces of the tube, as the swaging process continues and takes place. Obviously, it is desirable to have the compression dies exert enough force to override the pressure of the internal dies exerted by the collapsible mandrel internally of the tube, so that through the computer program operations of the various dies, the precise dimension sought for the end swaged tube will be achieved, within close tolerances. Normally, on a 4 inch tube, it is desired to reduce its external dimensions to approximately 3¾ inches, along its side, in order to allow that crimped segment of the tube to insert within the next adjacent tube, during their assembly.

As a further embodiment of the current invention, the concept is to provide a sort of machine dies that can compress on the outside of the tube that will squeeze the square or rectangular tube into lesser dimension, particularly at their ends where they join with related tubes of standard size. Most of the machines available for achieving a swaging operation normally have been designed to work with the round tube. It is not known, or it has not been found that there are machines that can be used to swag a square or rectangular tube. The reason probably for this is that it will take eight segments of a die that are generally compatible with each other to provide for the swaging of the sides and corners of the square or rectangular tube. In the modified concept, there are the outer dies that compress inwardly against the segment or the end of the tube, but it also requires internal dies or a solid die that provide support, or internal dimensional support, but yet provide dies that in the first instance will have a tendency to shrink in size, as the swage process progresses. Utilizing internal dies, within the tube, to provide support, it was determine that the dimension of the dies were desirable if they were the dimensions for the final I.D. for the tube that was to be obtained after the swaging operation. Thus, while it was known that to squeeze the tube would cause some buckling, even if the internal dies were of the final I.D. as desired, the hope was that the buckle would straighten itself out as the swage progressed towards the solid metal. Then, the final problem would be getting that solid piece of metal out of the swaged tube, since the tube would be compressed upon that internal die, after the process. Compressing the outer dies against the tube end, and forcing the tube end against the internal die, provided a swage that looked quite effective, and while the wall buckle during the process, they then straighten themselves out once they were forced against the solid arbor or mandrel. On the other hand, it took significant time to get the internal mandrel out of the tool, after the swaging process. Thus, this required modification to the internal die, forming the internal mandrel, and it achieved this through providing a central aperture through the mandrel and inserting a rod into that opening, and then providing a stop, such as by screwing a nut onto the end of the rod, and then pull the rod and its mandrel from the swaged tube end. Providing a rod within the mandrel, and lubricating it with a spray or other oil, before the swaging operation, made it easier to use impact, such as with a slide hammer provided upon the external portion of the rod, to simply hit the rod and pull the mandrel free from internally of the swaged tube end. Tapering the die surface also facilitates the removal of the internal die.

Another method for removing a mandrel, particularly in the case where the mandrel is collapsible, is to supply a tapered mandrel, to keep it at the internal dimension desired for the swaged tube end, and then hitting that tapered rod with a slide hammer to loosen it and allowed it to be pulled free from the swaged end of the square or rectangular tube, being reduced in dimensions.

It is, therefore, the principal object of this invention to provide a tube swaging apparatus, that incorporates cooperating external pressures through the use of compression dies to reduce the dimensions of a tube, while simultaneously using a collapsible mandrel to exert a lesser pressure internally of the tube, in alignment with the compression dies, to achieve a swaging of a tube portion, or its end, without any wall buckling.

Another object of this invention is to provide for an automated and software controlled hydraulically forced compression of external dies, and the arrangement of internal dies or die, to achieve precise swaging of a square or rectangular tube to precise lesser dimensions, without any irregular deformation of the tube walls.

Another object of this invention is to provide an automatic swaging process, incorporating a high degree of pressure, to swage the dimensions of a tube to precise lesser dimensions as required.

Still another object of this invention is to provide a swaging process for a tube, wherein neither the compression dies, nor the collapsible mandrel, will bind upon the outer or inner surfaces respectively of the tube, after completion of a swaging process.

A further object of this invention is to provide for the automatic swaging of a square or rectangular tube, within close tolerances.

These and other objects may become more apparent to those skilled in the art upon review of the summary of the invention as provided herein, and upon undertaking a study of the description of its preferred embodiment, in view of the drawings.

DESCRIPTION OF THE PREFERRED EMBODIMENTS

Figure 1:
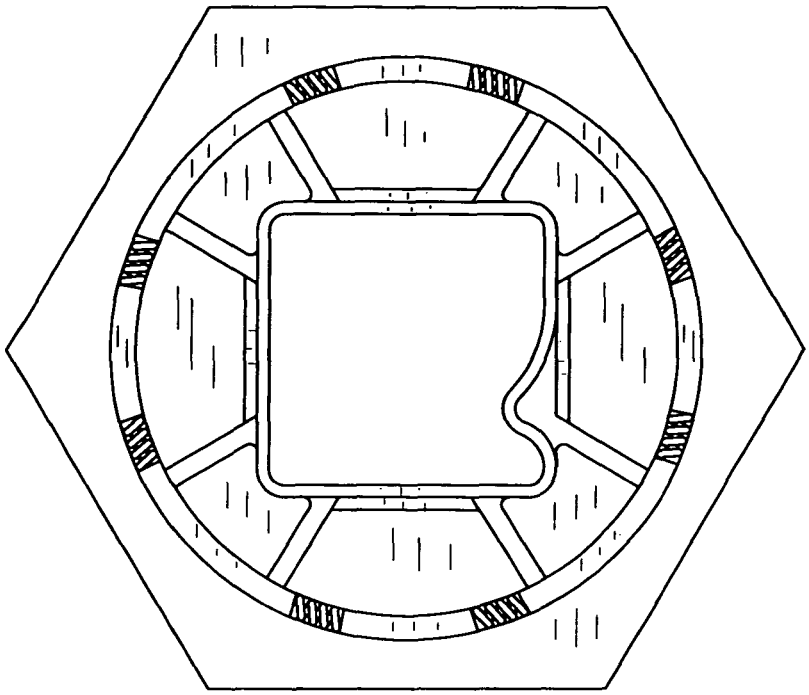
FIG. 1 therein is shown a prior art system for swaging a tube disclosing how the walls of the tube buckle without the use of any collapsible or solid mandrel therein.
Figure 2:
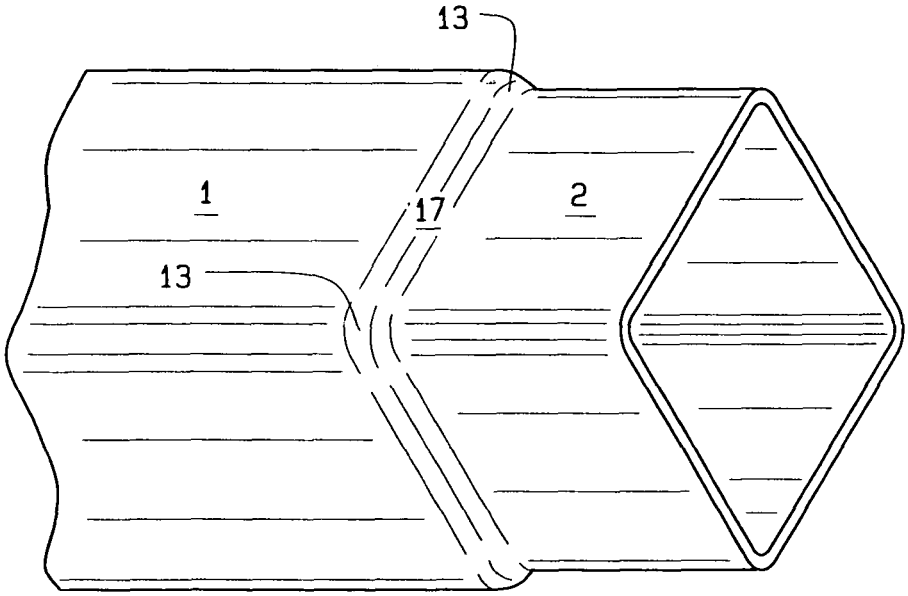
FIG. 2 shows a standard tube, approximately four inches along a side, that has been crimped to reduce the exterior dimensions of the tube, as can be seen, through usage of the apparatus and process of this invention.

In referring to the drawings, and in particular FIG. 2, therein is shown, in this instance, a square tube 1 wherein approximately 4 to 6 inches of its end, as at 2, has been swaged, so as to reduce its size, without any buckling or misforming, as noted in FIG. 1, so as to allow this crimped end of the tube to be inserted into a comparable adjacent tube, when it is desired to form a tube of substantial length. For example, in developing a communications tower, it may exceed 100 feet in height, and at least four sections of a tube, each being approximately 24 to 25 feet in length, may be coupled together, by means of interconnecting the swaged ends, to form a tower of that substantial dimension. Or, a series of these types of tubes may be interconnected together, over some length, to provide a support for holding many solar panels, in place, during the generation of solar power. As previously reviewed, these ends may be fastened together with bolts, a clamp, or even welded, to secure the same together, but having a solid segment of a swaged end of tube locating within the next adjacent tube, provides a very snug fit therein, and substantial strength to maintain the length of tube, once it is assembled into its desired length.

Figure 3:
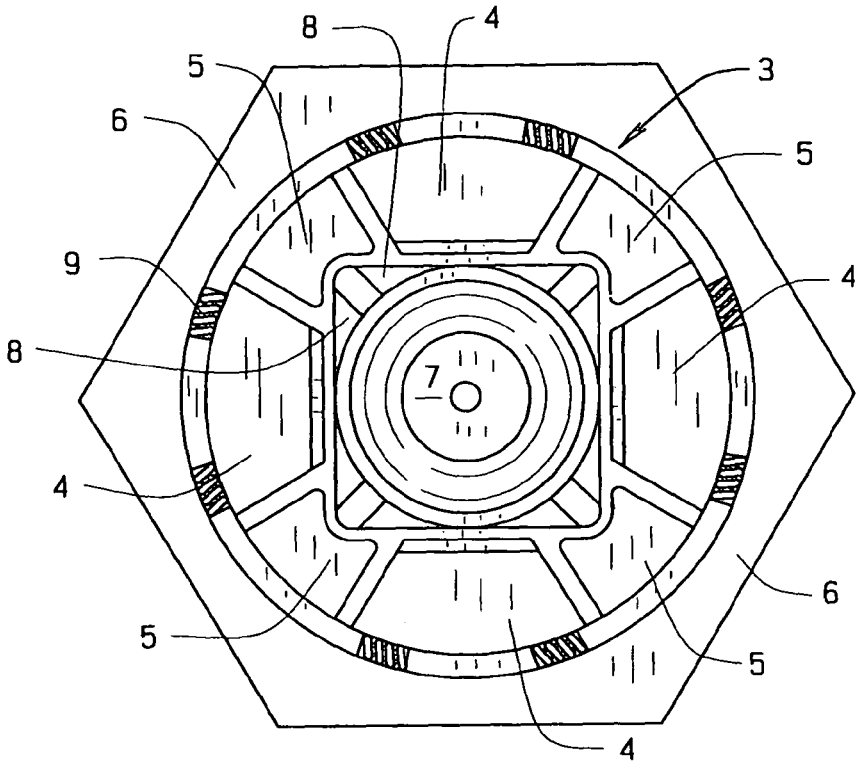
FIG. 3 shows a front view of the apparatus of this invention, disclosing the external compression dies, and the internal dies mounted upon a collapsible mandrel during the process of swaging the shown tube.

FIG. 3 shows the swaging apparatus 3, disclosing the assembled apparatus, with its external compressive dies, such as the flat compression dies 4 having the corner compression dies 5 held by their press support 6, and further showing the compressible mandrel 7, with its internal dies 8, being arranged within the apparatus, and which locate within the tube to be swaged.

It can be noted that the external compression dies are arranged generally having four of them biasing against the surface of the tube to be swaged, while the corner dies fit upon the corners of the tube, and will compress upon the corners, during the operations of the swaging apparatus. Furthermore, it can be seen that various springs 9 are provided for holding the supports that hold the dies within the press, and forces their separation, and expansion, after a swaging operation has been completed. In actuality, the support 6 or the compression members of the press apparatus, is the machine that provides for both holding the compression dies 4 and 5 in place, and which exerts significant pressure to force the dies 4 and 5 inwardly, for swaging of the end of the tube 1, when a swaging operation is effected.

Figure 4:
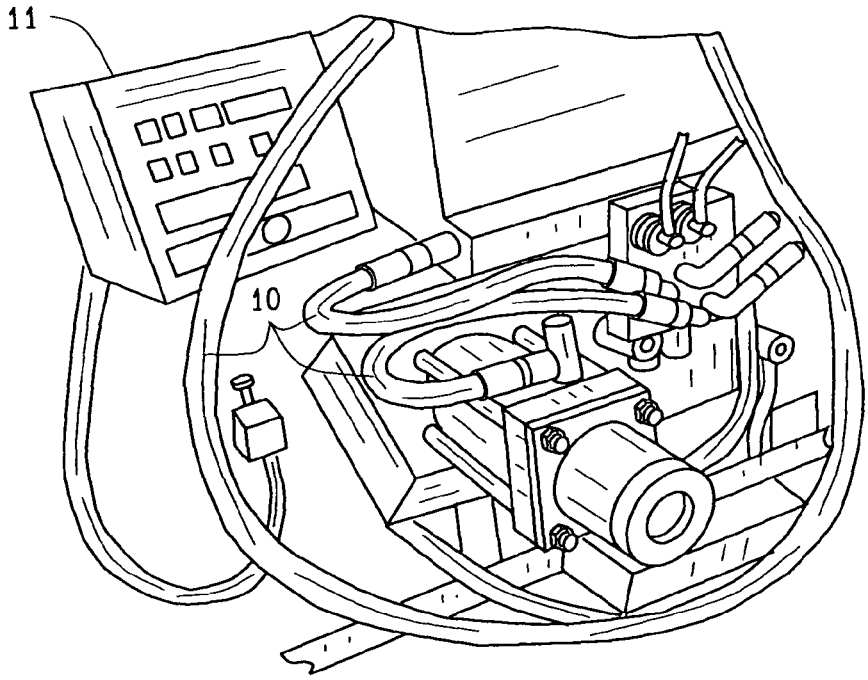
FIG. 4 shows the hydraulics used for generating the types of pressures needed to function the compression dies, and the internal collapsible mandrel, during performance of the process of this invention.

FIG. 4 shows the hydraulic operations for the collapsible mandrel 7 and the external dies and their supports, (see FIG. 6) which includes various hydraulic lines 10 operated by a controller 11 and in association with various hydraulic cylinders, and valves, in addition to a pump, provides for the compressive force necessary for functioning of the collapsible mandrel and compression dies, during their usage. Likewise, similar type of hydraulic pressure is applied to the external compressive dies 4 and 5, as stated and their machine supports 6 which force them inwardly from their support, when performance of a swaging operation, upon a square tube, as shown, is performed. Obviously, all of these operations can be controlled by a computer, and specialized software to attain quality and precise operations.

Figure 5:
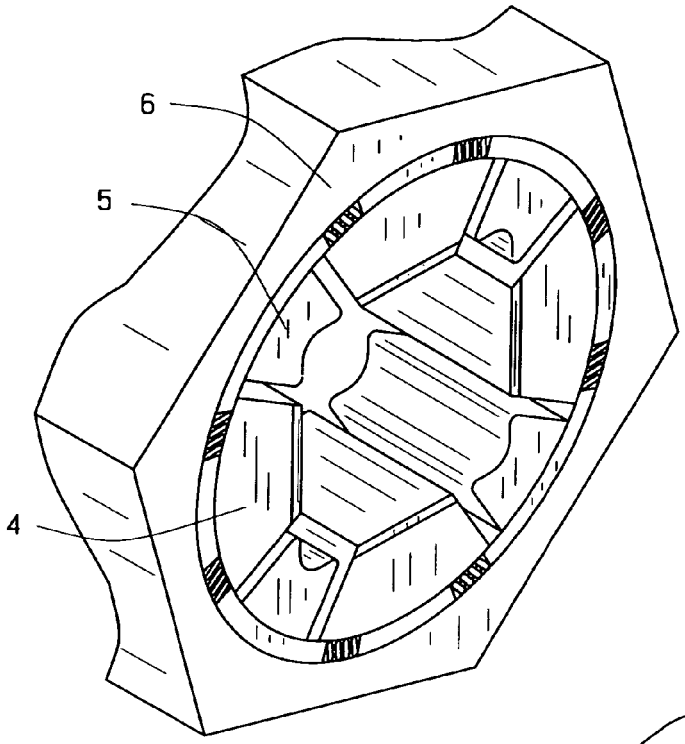
FIG. 5 shows the arrangement of the external compression dies, mounted within its support, and which are hydraulically controlled, to exert significant pressure, through contraction, to crimp, in this instance, a square tube, particularly at its end.

FIG. 5 shows the support 6 for the press machine for the outer compressive dies 4 and 5, without the location of a tube to be crimped therein, and with its collapsible mandrel removed. Such a press machine can be obtained from Uniflex Hydraulik GmbH, of Frankfurt, Germany.

Figure 6:
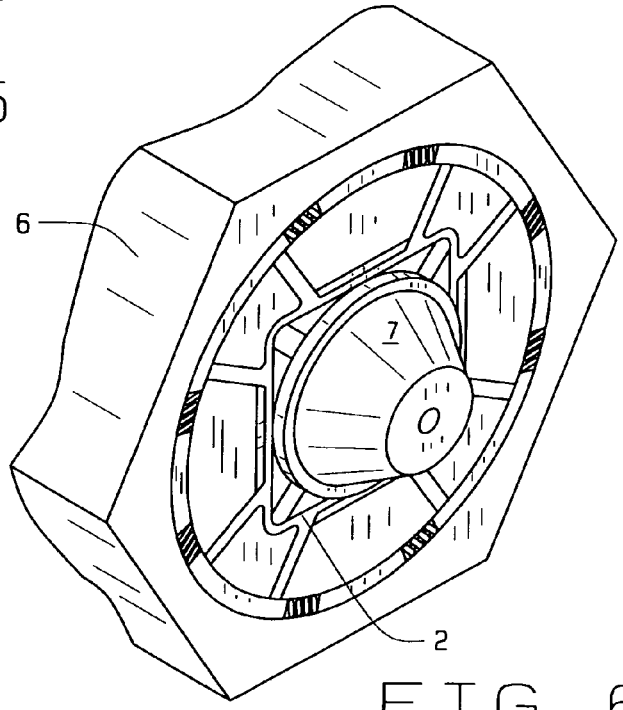
FIG. 6 shows the collapsible mandrel, with its internal dies, arranged and located within the exterior compression dies of this apparatus.

FIG. 6 shows a similar view to FIG. 5, but showing the collapsible mandrel 7 arranged within the apparatus, in preparation for the location of a square tube therein, when readied for its swaging.

Figure 7:
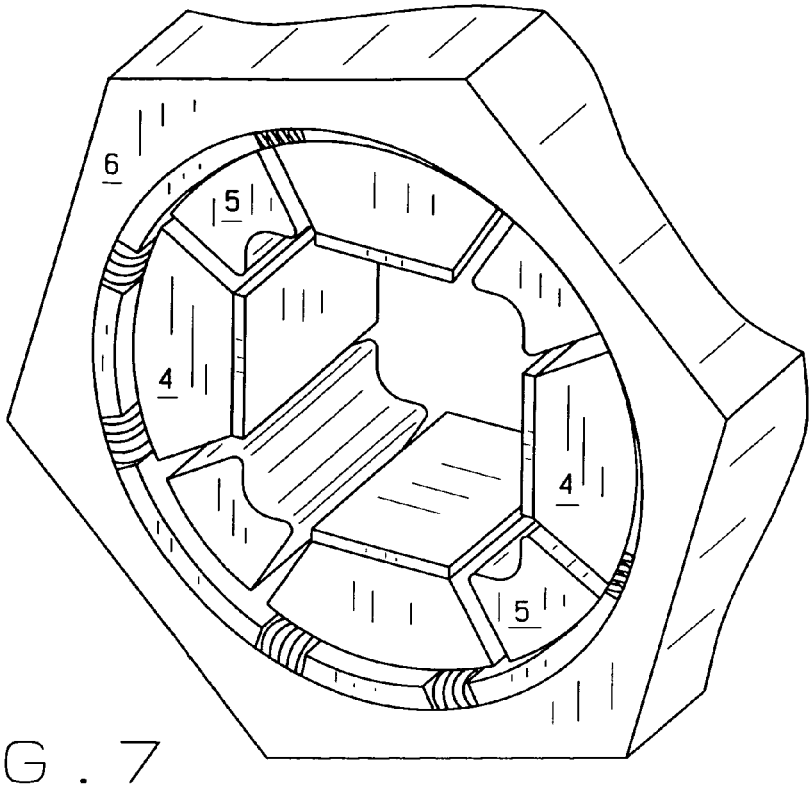
FIG. 7 shows the exterior compression dies located within its press support when readied for performing a swaging operation.

FIG. 7 provides another view of the support 6 for the apparatus, and showing the location of its outer compression dies 4 and 5, and how they are held in an observable square position within their support in preparation for a tube swaging operation.

Figure 8:
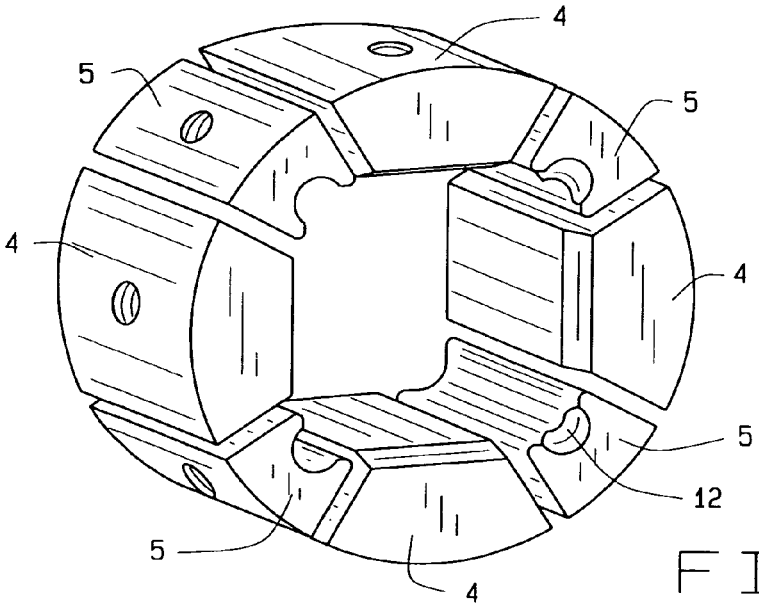
FIG. 8 shows the various external compression dies, without their support, within a hydraulic press machine, as being arranged for holding the end of a square tube, in preparation for its swaging.

FIG. 8 shows a schematic view Of the outer compression dies, from an interior position, their relative dimensions and locations, as for use for swaging a four inch tube, but with its outer press support removed. Also, the radius 12 provided upon each of the corner dies provides for a very smooth transition between the standard tube 1, and its crimped surface 2, as can generally be noted at 13, in FIG. 2.

Figure 9:
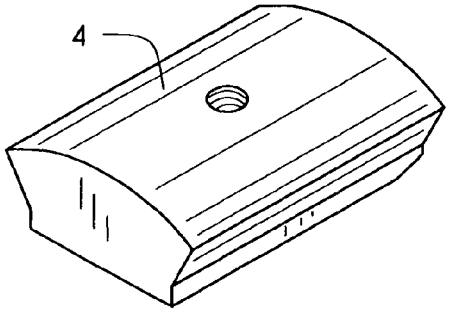
FIG. 9 discloses one of the external compression die, of the type that is compressed against the flat wall surfaces of the tube, during a swaging operation.
Figure 9A:
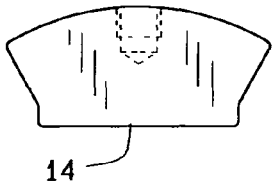
FIG. 9*a* shows an end view of the compression die of FIG. 9.
Figure 9B:
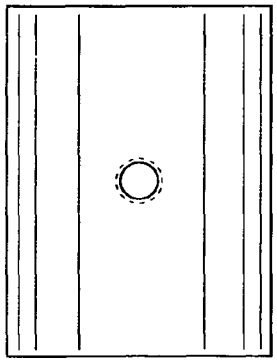
FIG. 9*b* shows a plan view of the compression die of FIG. 9.
Figure 9C:
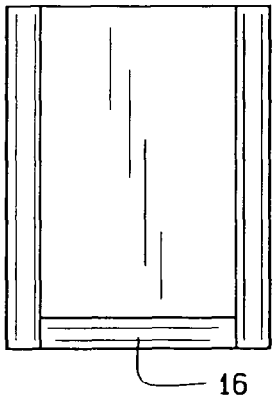
FIG. 9*c* shows an interior face view of the compression die of FIG. 9.
Figure 9D:
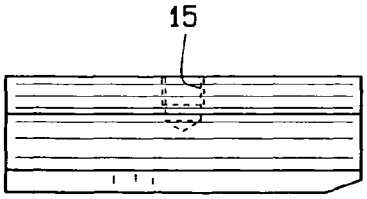
FIG. 9*d* shows a side view of the compression die of FIG. 9.

FIGS. 9 through 9*d* show the shape, structure, and the function of an outer compression die, as noted at 4, and which includes a flattened surface, as at 14, and it is that flattened surface which biases against a flat side wall of the tube to be crimped, in order to provide for the inward pressure necessary to reduce the dimensions of the tube, during a swaging function. In addition, it can be seen that each compression die has a threaded aperture provided therein, as at 15, and into which a rod may insert, and which rod may be manipulated by either hydraulic means, or support means, to force the dies inwardly, during a swaging operation, or to pull them outwardly, after completion of the crimping of the end of a tube. Such a rod holds the dies to the machine press supports 6. In addition, there is a slight bevel 16 provided at one end of each die, and this likewise provides for the uniformity of incline, as at 17, between the outer surface of the tube, and the swaged surface 2, as can be seen in FIG. 2.

Figure 10:
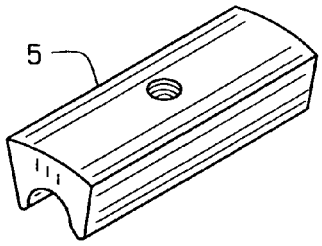
FIG. 10 shows an isometric view of an external corner compression die of this invention.
Figure 10A:
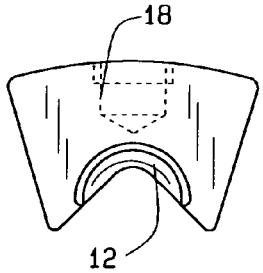
FIG. 10*a* shows an end view of the corner compression die of FIG. 10.
Figure 10B:
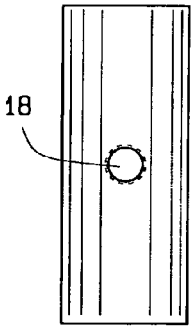
FIG. 10*b* shows a top view of the corner compression die of FIG. 10.
Figure 10C:
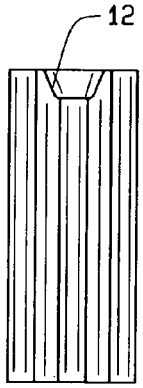
FIG. 10*c* shows an inner view of the compression die of FIG. 10.
Figure 10D:
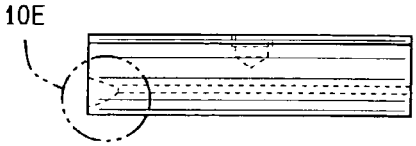
FIG. 10*d* shows a side view of the compression die of FIG. 10.
Figure 10E:
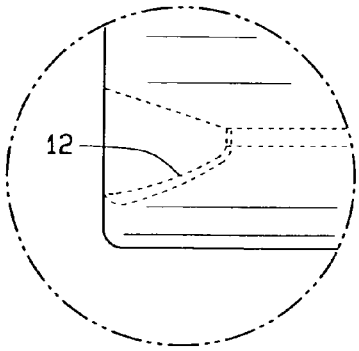
FIG. 10*e* shows a detailed view of the radius provided at one end of the compression die of FIG. 10, in order to provide for a slight bevel at the juncture between the crimped tube and its regular outer surface.

FIGS. 10 through 10*e* show the external corner compression dies 5, as previously reviewed, and it can be seen that it has a length commensurate with the approximate length of the swage to be performed upon the tube, and likewise, this die has a threaded aperture 18 to allow the engagement therein of a rod, to connect with the press supports 6, that may be either hydraulically or mechanically actuated, when applying significant pressure to the corner die, to force it inwardly, and to attain the swaging operation of the embraced tube. Likewise, that contoured edge 12 of the die, forms that uniform contour 13 between the two parts of the tube 1 and 2, as is also shown.

Figure 11:
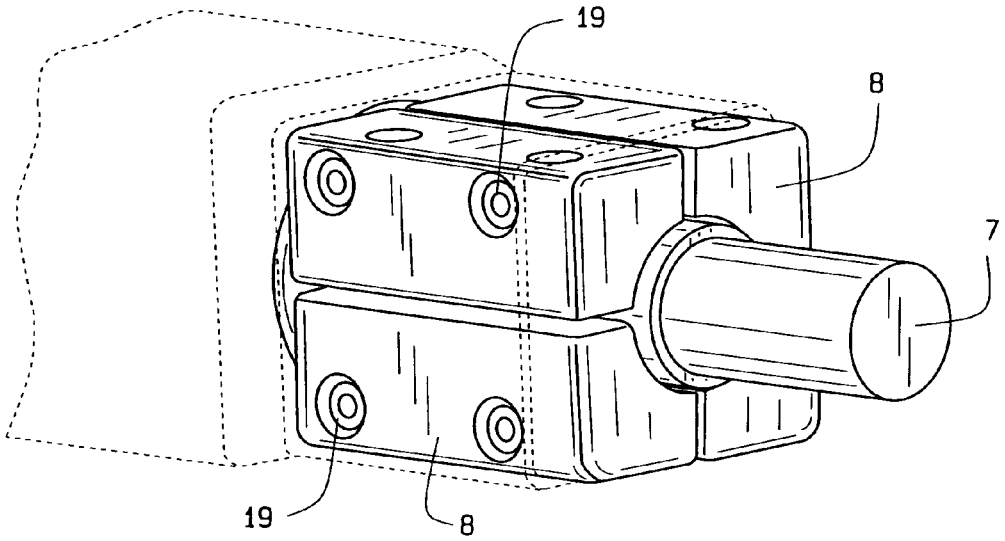
FIG. 11 shows an example of a collapsible mandrel used internally of the tube during a swaging operation.

FIG. 11 shows the location of the compressible mandrel, as at 7, and its internal dies 8, mounted thereon, and which mandrel functions to exert pressure upon said dies, to force them radially outwardly, when adding a compressive force against the interior of the part of the tube 2 being swaged, as can be understood. Various means 19 are provided for holding the internal dies upon the mandrel or arbor 7, so that as the tapered mandrel is shifted, either mechanically, or hydraulically, to provide a degree of force upon the expansion of the internal dies 8, against the interior of the tube to be crimped, this force can be precisely regulated to be slightly less than the type of force exerted upon the tube by the external compression dies 4 and 5, to allow swaging to take place, and to do so uniformly during an operation.

Figure 12:
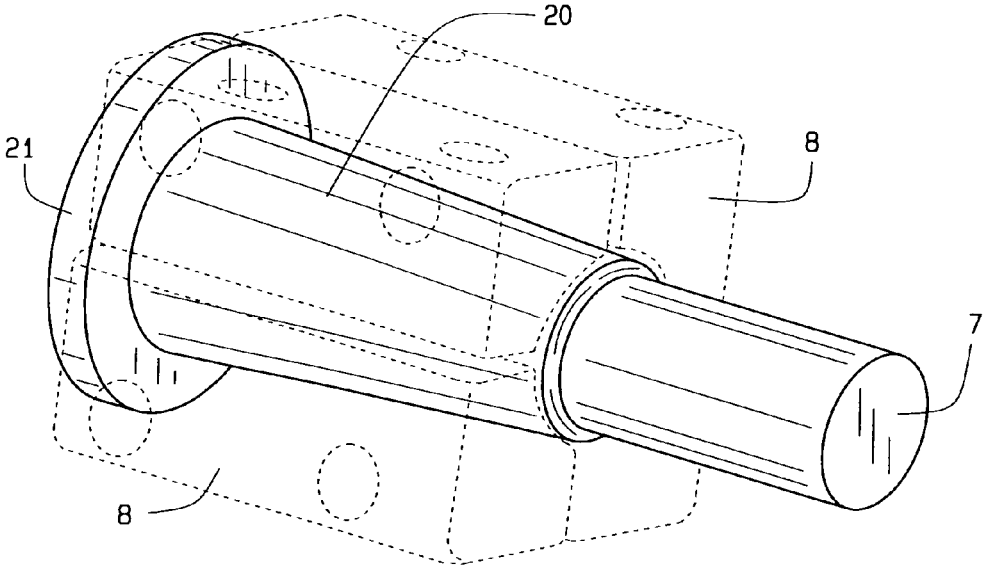
FIG. 12 shows a mandrel located within the various internal compression dies, as shown in phantom line.

FIG. 12 provides a view of the tapered mandrel or arbor, within the various internal dies 8, which are shown in phantom line. It can be seen that the mandrel 7 has a taper 20 provided upon its length, with a flange furnished at its inner end 21, so that as the arbor is pulled, for example, to the right, it forces the internal dies 8 outwardly, to apply pressure or seat against the interior of the tube walls, and to prevent their buckling as during a swaging function.

Figure 13:
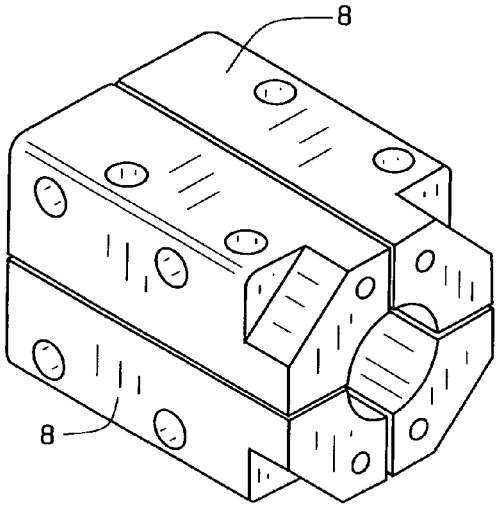
FIG. 13 provides an isometric view of the various internal compression dies that mount upon the mandrel for use with the apparatus of this invention.
Figure 13A:
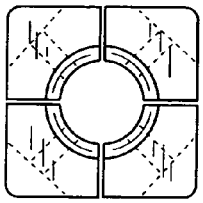
FIG. 13*a* is an end view thereof.
Figure 13B:
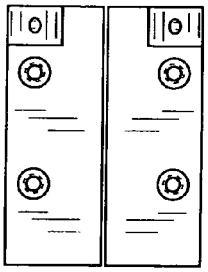
FIG. 13*b* is a top view.
Figure 13C:
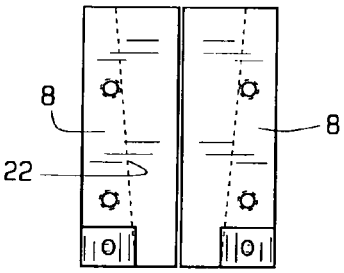
FIG. 13*c* is a bottom view.
Figure 13D:
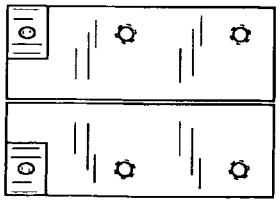
FIG. 13*d* is a side view.
Figure 13E:
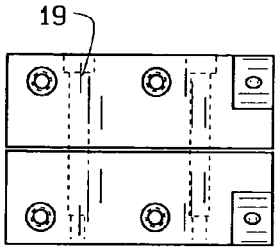
FIG. 13*e* is an opposite side view.

FIGS. 13 through 13*e* provide an isometric view of the dies 8, and showing the fastening means 19 that slidingly secures the various dies together, but allows for their radial expansion as during a swaging operation, as can be understood. The internal taper of the various dies, as can be noted at 22, can also be seen and this tapered surface within the various internal dies cooperate with the taper 20 of the mandrel, as it longitudinally shifts during a swaging function.

Figure 14:
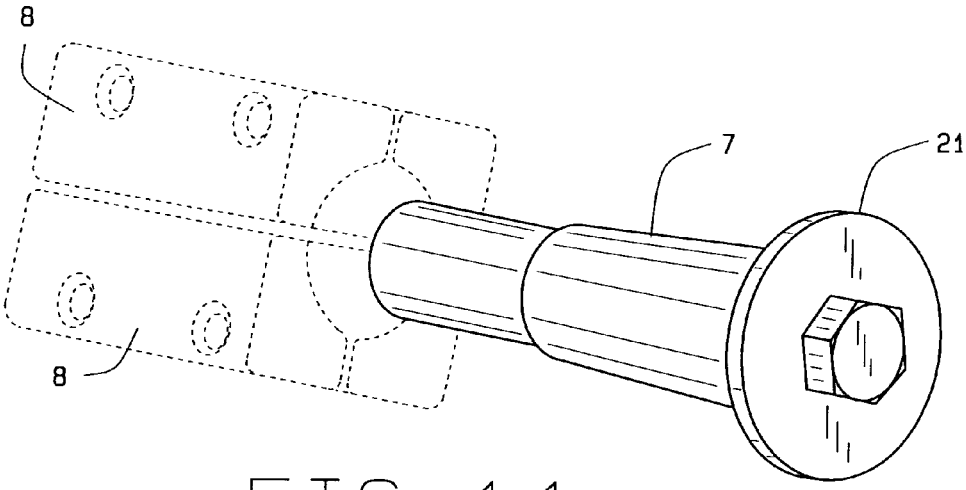
FIG. 14 shows another form of tapered mandrel that may be used in combination with the internal dies of the collapsible mandrel of this invention.

FIG. 14 provides a phantom view of the dies 8, there obviously being four in number mounted upon the collapsible mandrel 7, which is shown removed from its location within said dies, as during an assembling operation.

Figure 15:
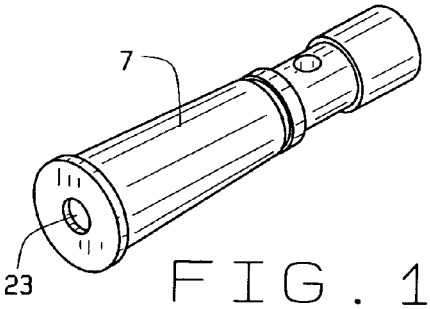
FIG. 15 provides an isometric view of the tapered mandrel or arbor of this invention.
Figure 15B:
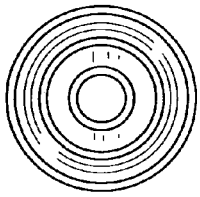
FIG. 15*b* shows an end view of the tapered mandrel.
Figure 15A:
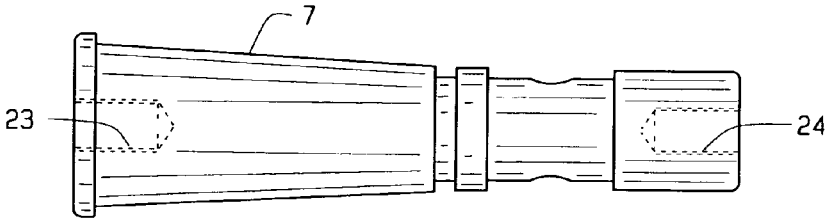
FIG. 15*a* shows a side view thereof.

FIGS. 15 through 15*b* show various other views of the tapered mandrel 7, and also disclose at one end, as at 23, a threaded end into which a rod may be engaged, and that rod may be either hydraulically functioned during a swaging operation, or it may be shifted, even mechanically, to contract the mandrel, after a swaging operation, and to remove the mandrel from within the crimped tube. There may also be a tapped hole 24 at the opposite end of the mandrel, for engagement of a rod therein, that may provide either hydraulic or mechanical impart movement to the arbor, during its functioning.

Figure 16:
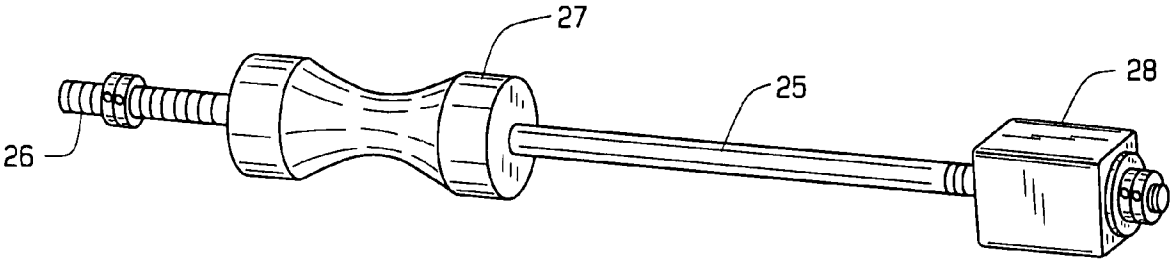
FIG. 16 shows a modification to a tapered arbor that may be removed from the swaging apparatus through the use of a manually operated hammer means.

FIG. 16 shows a type of rod 25 that may be threadily engaged, at its end 26, within one of the threaded apertures 23 or 24, when it is desired to manually remove the arbor 7 from a tube, after functioning. A sliding weight 27 may be forced against the block 28 when an impacting force is necessary to break the compressible mandrel free, to allow the internal dies 8 to radially contract, to achieve their removal from within the swaged tube.

Figure 17:
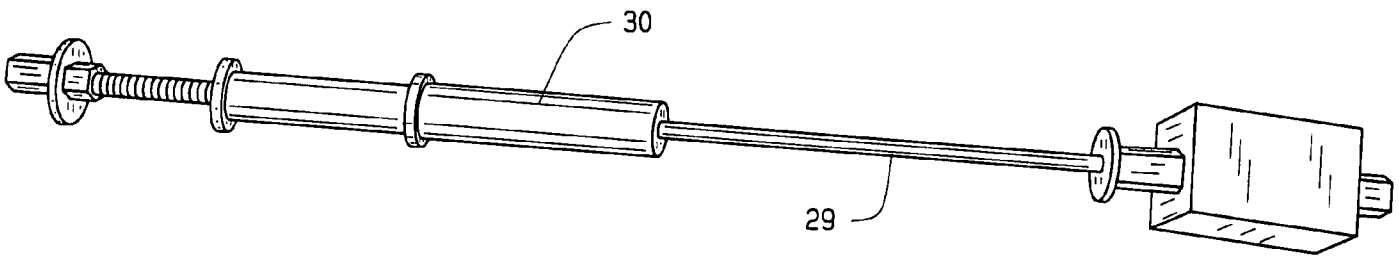
FIG. 17 shows a view of another form of tapered arbor with a manually operated hammer means to provide for its removal from within the tube held by the swaging apparatus of this invention.

FIG. 17 shows another type manually operated hammer, as at 29, having a weight 30 provided thereon to achieve removal of a collapsible arbor or mandrel from within a tube.

Figure 18:
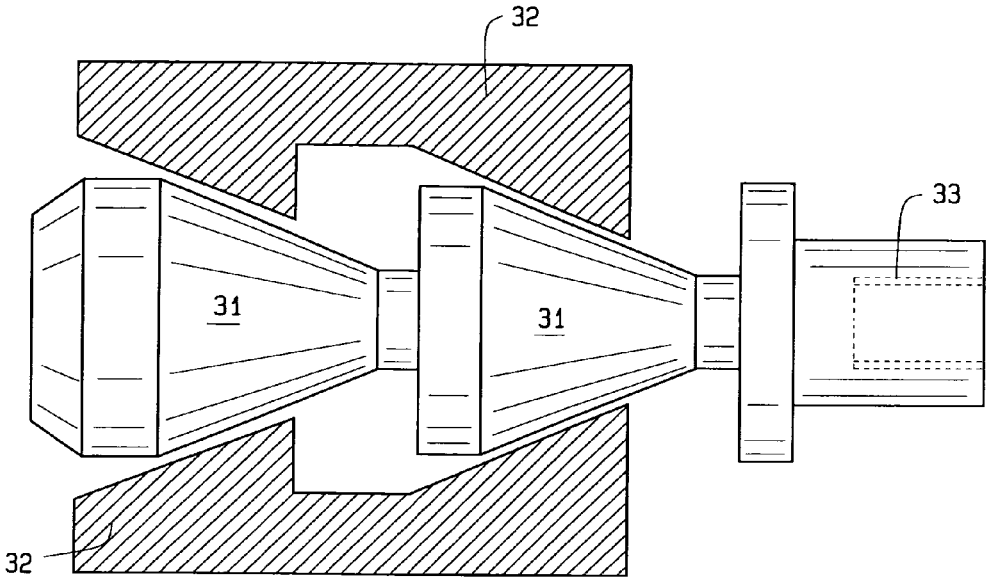
FIG. 18 shows a further modification for a double tapered arbor for the collapsible mandrel of this invention.

FIG. 18 shows a double tapered arbor 31 that may act within double tapered dies 32, in order to initially force the dies outwardly, to compress against the interior of the tube to be crimped, or to force the double tapered rod inwardly, to allow the dies 32 to compress, and to be freed and removed from the tube. This device also has a threaded end 33 to which a rod, similar to those shown in FIGS. 16 and 17, may be engaged, to help function in the removal of the collapsible mandrel, from within a tube.

Figure 19:
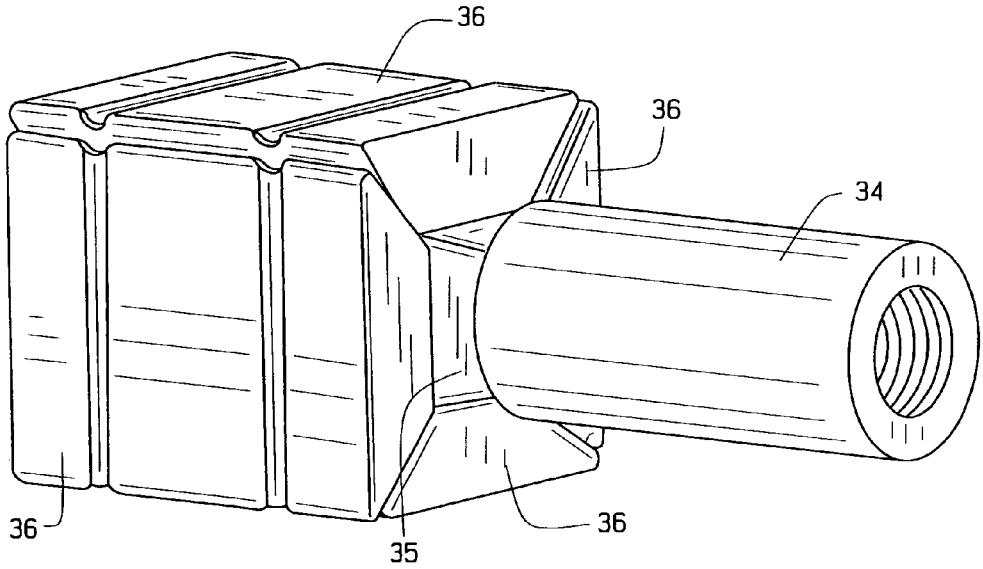
FIG. 19 shows a tapered arbor, located within its internal dies, in preparation for the use in the crimping apparatus.
Figure 20:
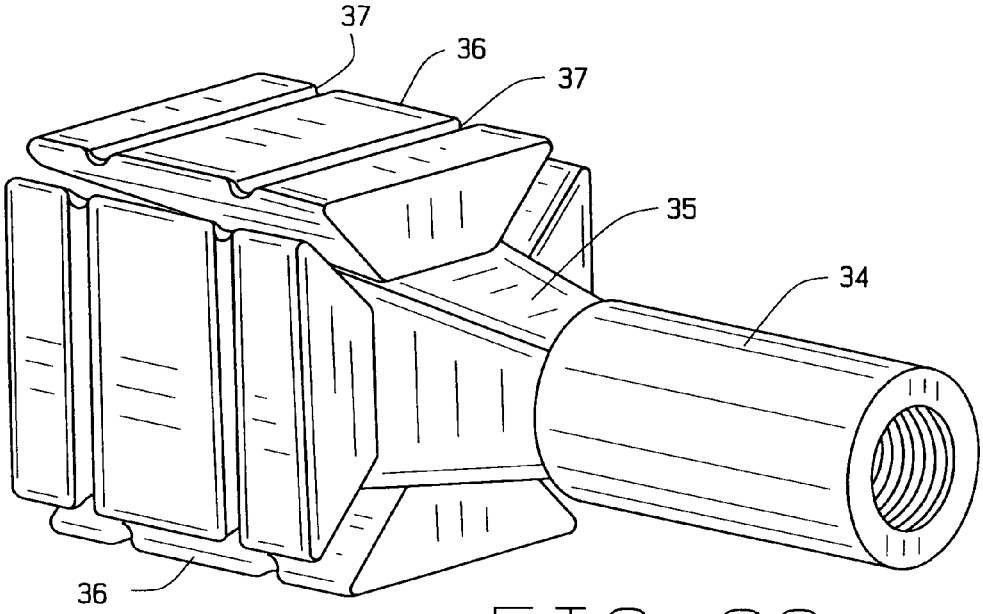
FIG. 20 shows the internal dies being forced outwardly, through the longitudinal shifting of the tapered mandrel during its usage.

FIG. 19 shows the preferred embodiment for the collapsible mandrel. In this embodiment, it includes an extended end 34 for the arbor, it has its tapered arbor portion 35 that extends within each of the internal dies 36, which when the arbor is pulled in one direction, as by mechanical force, or even hydraulic pressure, expands the dies 36 radially outwardly, and to that degree of pressure against the interior of the tube to be crimped, to keep if from buckling, as can be understood. Likewise, the arbor may be extended further inwardly, against its taper, to allow for a release of the internal dies 36, and allow them to contract radially inwardly, to free them automatically from the interior end surface of the crimped tube, and allow for removal of the collapsible mandrel, without the exertion of any substantial force, from within the collapsed tube. FIG. 20 shows the arbor 34 as it is pulled in a direction, towards the right, thereby forcing through its tapered surface 35 to expand the interior dies 36 radially outwardly, with some degree of force, to bias against the interior of the tube, in preparation for a swaging operation. As previously explained, the amount of force exerted by the internal dies 36 against the interior of the tube, will be programmed to be less than the force applied by the compression dies 4 and 5, upon the outside of the tube, during a swaging operation. In addition, it can be seen that each internal die 36 has a groove 37 provided thereon, and a form of elastic means, such as cable, spring, or elastomeric band, or other means, may be located therein, in order to hold the various dies 36 in a biased condition upon the surface 35 of their mandrel 34, as can be understood.

Figure 21:
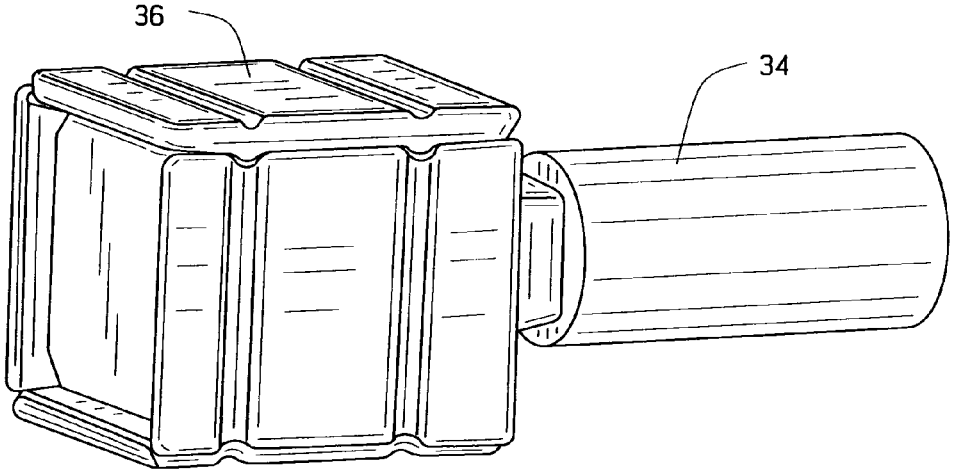
FIG. 21 provides another view of the internal dies and tapered arbor of this invention.

FIG. 21 shows the assembled collapsible mandrel 34, with its dies 36 provided thereon.

Figure 22:
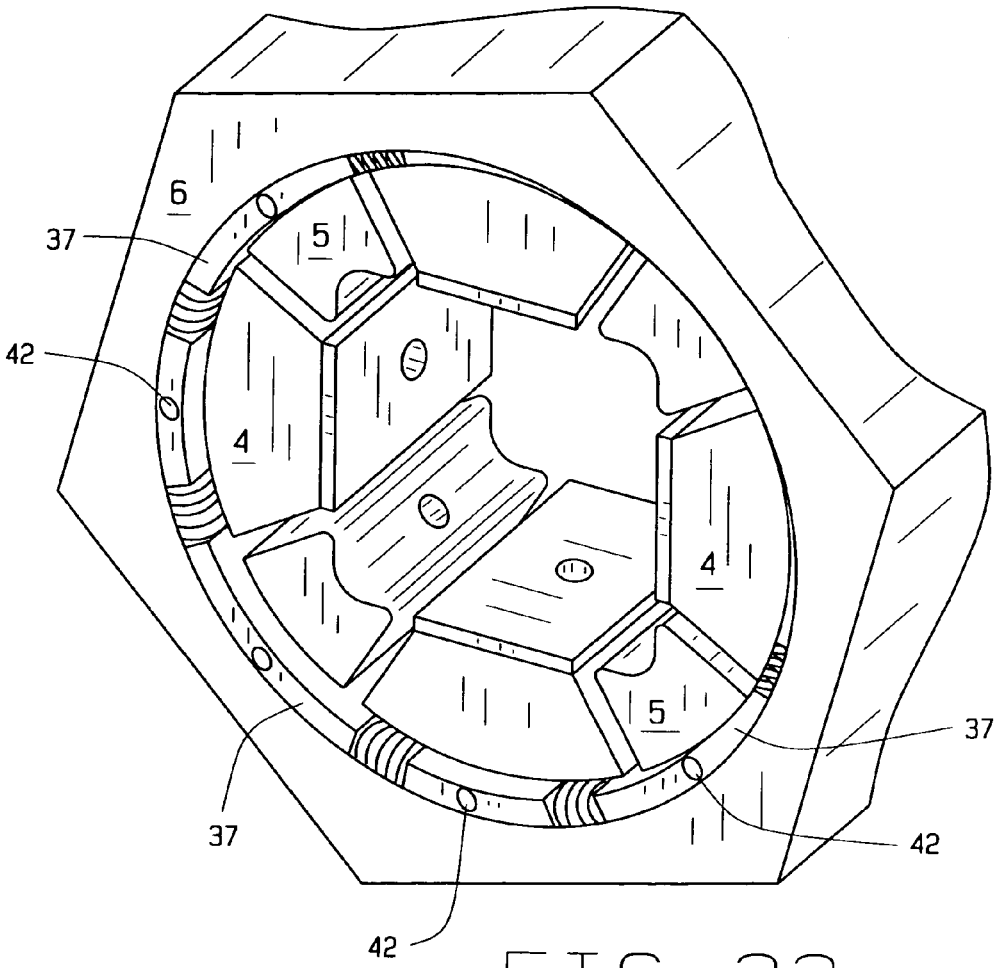
FIG. 22 provides a view of the various dies that provide for swaging of a tube into a lesser dimension, being mounted within the supports of the press that provides the force necessary to complete such an operation.
Figure 23:
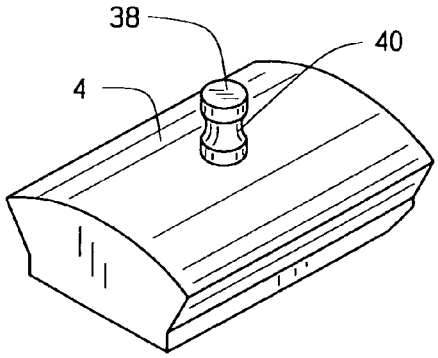
FIG. 23 discloses the flat surface die and its support mounting rod that swages the wall of the tube during a swaging operation.
Figure 24:
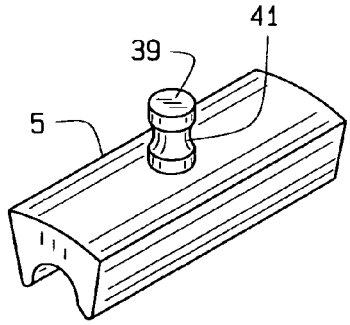
FIG. 24 provides an isometric view of a corner die and its support mounting rod for use during the swaging operation.

FIG. 22 shows the arrangement of the press support 6, which holds the hydraulically movable independent die supports 37, which further hold the external dies 4 and 5 in position within the hydraulic press. Each of the flat compression dies 4, in addition to the corner compression dies 5, has a rod 38 and 39 connected to their backsides, and these rods are designed for inserting into apertures provided within the die supports 37, and can located therein, and be held by a fastening member that locates within the groove 40 and 41 of each of these dies. See FIGS. 23 and 24. And, through the insertion of a tool into the die supports 37 and their apertures 42, the flat and corner compression dies 4 and 5 can be removed, and freed from their die supports 37, as can be understood. This just indicates how the corner and flat compression dies are held within the hydraulic press machine, and can be located in place, in preparation for a swaging operation to be preformed by the machine, through the forceful compression of the flat and corner dies 4 and 5 against the end of a tube, being swaged.

Figure 25:
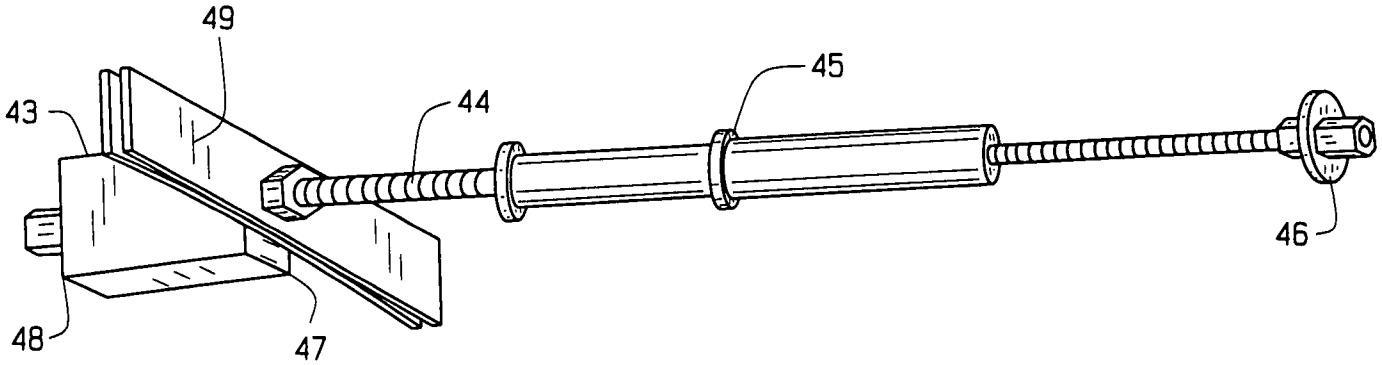
FIG. 25 provides an isometric view of another form of hammer means that can connect with a solid or collapsible mandrel in order to impact its removal from the swaged tube end, after a swaging operation.

The type of internal die 43 to be used within the end of a tube 2 (see FIG. 6) to be swaged can be seen in FIG. 25. When a tube end is located within the press 6, and arranged precisely within the various corner and flat compression dies 4 and 5, the internal die including its die block 43 locates within the interior of the end of the tube 2, and it has a dimension approximating the final dimension for the swaged end 2 of the tube 1. Then, its rod 44 supports a slidable weight 45, as can be seen, so that after a swaging operation, the weight can be rammed against its end 46, for forcing the internal die from the interior of the swaged tube, upon completion of a swaging operation. To facilitate its removal, the die block may have a slight taper, a few thousands of an inch, being greater at its external end 47, from that of its internal end 48, so that the slight taper facilitates the removal of the die block from within the swaged end of the tube, when the process is completed. Furthermore, as previously summarized, a lubricate may be sprayed onto the internal die block, to further aid in its breaking free from within the swaged end of the tube, to allow it to be removed, when the slidable weight or weighted hammer is impacted upon its end, to attain removal of the internal die. As can further be noted, there is a placement bar 49 that extends across the approximate front end of the internal die, so as to determine its depth of precise insertion within the tube, in preparation for a swaging operation. This prevents the swaged tube from crimping over the end of the die 43.

Figure 26:
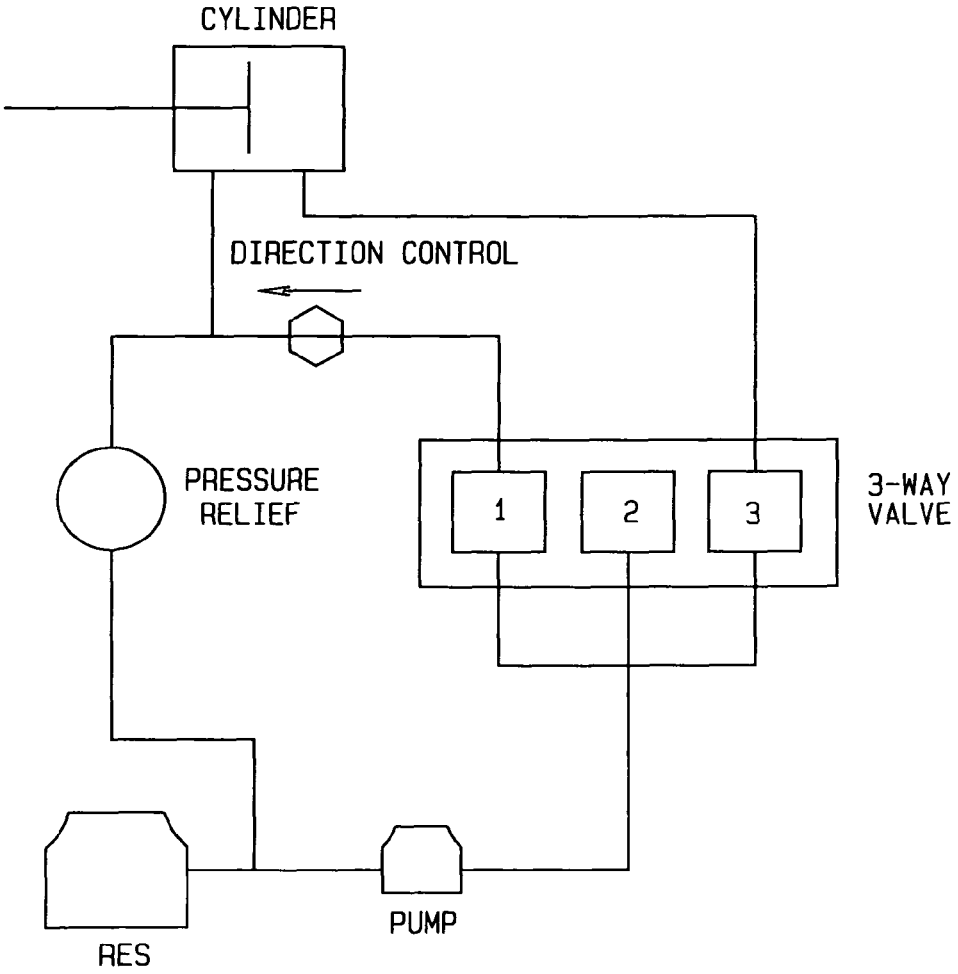
FIG. 26 discloses the hydraulic schematic that may provide for the delivery of hydraulic pressure to both the external compression dies and the internal dies of the collapsible mandrel, for the apparatus of this invention.

FIG. 26 shows the schematics of a hydraulic circuitry for operating a cylinder, that can apply pressure to the external dies 4 and 5, to force them inwardly, and apply pressure against the tube during a swaging operation, or likewise, through the same type of schematic can apply hydraulic pressure to the collapsible mandrel 34, to force it outwardly, or inwardly, during a swaging operation, in order to maintain that balance of forces against both the exterior, and the interior, at end of the tube to be swaged, as has been explained. As can be noted, the circuitry includes a reservoir for the hydraulic fluid, a pump, various valves, a directional control means for directing hydraulic pressure to either the external dies, or the collapsible mandrel, through pressure applied to the cylinder, as noted. There is also a pressure relief valve in the event that hydraulic pressure builds up too excessively during an operation. There may also be included within the circuitry a vent, which when the three-way valve is actuated, it allows for venting of the pressure back to the reservoir, when a swaging operation has been completed.

Variations or modifications to the subject matter of this invention may be considered by those skilled in the art upon review of the development as explained herein. Such variations, if within in the spirit of this invention, are intended to be encompassed within the scope of any claims to patent protection issuing hereon. The depiction of the invention in the preferred embodiment, and its disclosure in the drawings, is primarily set forth for illustrative purposes only.

We claim:

1. A swaging apparatus for use for reducing the dimensions for a multi-walled tube including a support, a series of external compression dies, said external compression dies operatively supported by the said support, there being an external compression die having a flat surface provided in alignment with each wall of the multi-wall tube being swaged and which said compression dies when actuated, directs said compression dies against the surface of the tube to swage it and reduce its dimensions;

a collapsible mandrel, said collapsible mandrel including a tapered arbor, a series of internal compression dies, said internal compression dies mounted upon said tapered arbor, and said collapsible mandrel, when actuated, forcing said internal compression dies against the interior surface of the tube to be swaged, in alignment with the exterior compression dies, and exerting a lesser force upon the internal walls of the tube, than the pressure exerted by the external compression dies upon said tube to prevent buckling of the tube during performance of a swaging operation.

2. A method for crimping a segment of a square or rectangular tube, including locating a tube within a swaging apparatus, moving a series of external compression dies under significant force against the surfaces of the emplaced tube, in order to initiate swaging, actuating internal compression dies against the interior surface of the same part of the tube but under a force less than the pressure applied by the external compression dies upon the outer surfaces of said tube, continuing to exert a compressive force upon said tube, until it swages to a lesser dimension than the original tube, to complete its swaging operation.

3. The method for swaging a square or rectangular tube of claim 2, wherein removing the external compressive dies from the surface of the tube after completion of a swaging operation, and removing the internal compression dies and its collapsible mandrel from within the tube after completion of a swaging function.

4. A swaging apparatus for use for reducing the dimensions for a multi-walled tube including a press machine support, a series of external compression dies, said external compression dies operatively supported by the said support, and which when actuated, directs said compression dies against the surface of the tube to swag it and reduce its dimensions;

said external compression dies includes a series of flat compression dies for biasing against the flat walls of any tube to be swaged, and external corner dies, which when actuated, forcefully compresses against the corners of the tube being swaged, during a swaging operation;

a mandrel, comprising an internal die, said mandrel connecting with a rod, said rod having a weighted member provided thereon for impacting against an end of the rod to force a removal of the internal die from within the tube after completion of a swaging operation;

wherein said internal compression die operatively prevents the swaged end of the tube from buckling upon completion of a swaging operation, while the external flat and external corner dies are forced by the press machine support into forcefully biasing against the outer contours of the end of the multi-walled tube to swage it into a lesser dimension.

5. The swaging apparatus of claim 4 wherein said external compression dies are hydraulically actuated during a swaging operation.

6. The swaging apparatus of claim 5 wherein said external corner compression dies include a radius, to provide an angled transition between the tube and its swaged surfaces.

7. The swaging apparatus of claim 6 wherein said external compression dies include a bevel at one end to provide a slanted transition between the tube and its surfaces being swaged.

8. The swaging apparatus of claim 4 wherein said internal die has a slight taper along its length to facilitate its removal from within the end of the swaged tube upon completion of a swaging operation.

9. The swaging apparatus of claim 4 wherein there are four flat compressions dies included in the series of flat compression dies.

10. The swaging apparatus of claim 4 wherein there are four external corner dies included in the series of corner dies.

11. A swaging apparatus for use for reducing the dimensions for a multi-walled tube including a support, a series of external compression dies, said external compression dies operatively supported by the said support, there being an external compression die having a flat surface provided in alignment with each wall of the multi-wall tube being swaged and which said compression dies when actuated, directs said compression dies against the surface of the tube to swage it and reduce its dimensions;

a collapsible mandrel, said collapsible mandrel including a tapered arbor, a series of internal compression dies, said internal compression dies mounted upon said tapered arbor, and said collapsible mandrel, when actuated, forcing said internal compression dies against the interior surface of the tube to be swaged, in alignment with the exterior compression dies, and exerting a lesser force upon the internal walls of the tube, than the pressure exerted by the external compression dies upon said tube to prevent buckling of the tube during performance of a swaging operation;

said external compression dies include a series of flat compression dies for the flat walls of any tube to be swaged and external corner dies, which when actuated, forcefully compress against the corners of the tube being swaged, during a swaging operation.

12. The swaging apparatus of claim 11 wherein said external compression dies and internal compression dies are mechanically actuated during a swaging operation.

13. The swaging apparatus of claim 11 wherein said external compression dies and internal compression dies are hydraulically actuated during a swaging operation.

14. The swaging apparatus of claim 13 wherein said external corner compression dies includes a radius, to provide an angled transition between the tube and its swaged surfaces.

15. The swaging apparatus of claim 14 wherein said external compression dies include a bevel at one end, to provide a slanted transition between the tube and its surfaces being swaged.

16. The swaging apparatus of claim 13 and including a hydraulic circuit including a hydraulic cylinder, a hydraulic reservoir, a hydraulic pump, and various valves, wherein the hydraulic pump pressurizes fluid to activate the hydraulic cylinder for forcing the exterior and inner compression dies during a swaging operation.

17. The swaging apparatus of claim 12, and including a weighted member secured with one end of the arbor, for applying pressure against the arbor to force it inwardly against the inner compression dies during a swaging operation, and said weighted member provided for impacting against the arbor to remove it from the internal dies within the tube after completion of a swaging operation.

18. The swaging apparatus of claim 17 wherein said weighted member includes a weighted hammer slidingly mounted upon the rod connecting with one end of the said arbor of the collapsible mandrel.

* * * * *